US005234327A

United States Patent [19]

Martin

[11] Patent Number: 5,234,327

[45] Date of Patent: Aug. 10, 1993

[54] APPARATUS FOR MELT SPINNING WITH HIGH PULL-OFF SPEEDS AND FILAMENT PRODUCED BY MEANS OF THE APPARATUS

[75] Inventor: Horst Martin, Cham, Switzerland

[73] Assignee: Viscosuisse S.A., Emmenbrücke

[21] Appl. No.: 918,947

[22] Filed: Jul. 22, 1992

Related U.S. Application Data

[63] Continuation of Ser. No. 490,559, Apr. 17, 1990, abandoned.

[30] Foreign Application Priority Data

Aug. 24, 1988 [CH] Switzerland ..... 3146/88

[51] Int. Cl.[5] ..... D01D 5/00

[52] U.S. Cl. ..... 425/72.2; 264/210.8; 264/211.14; 264/211.15; 425/66

[58] Field of Search ..... 264/210.1, 210.3, 210.8, 264/211.14, 211.15; 425/72.2, 66

[56] References Cited

U.S. PATENT DOCUMENTS

| | | | |
|---|---|---|---|
| 2,404,717 | 7/1946 | Houtz | 264/210.8 |
| 3,053,611 | 9/1962 | Griehl | 264/210.8 |
| 3,632,719 | 1/1972 | Nozawa | 425/72.2 |
| 3,679,786 | 7/1972 | Van Doornewaard et al. | 264/234 |
| 3,684,416 | 8/1972 | Lenk | 264/210.8 |
| 3,707,593 | 12/1972 | Fukada et al. | 264/289.6 |
| 3,939,639 | 2/1976 | Ellegast | 264/210.8 |
| 4,702,871 | 10/1987 | Hasegawa et al. | 264/348 |

FOREIGN PATENT DOCUMENTS

| | | | |
|---|---|---|---|
| 60-35444 | 8/1985 | Japan | 264/237 |

*Primary Examiner*—David A. Simmons
*Assistant Examiner*—William J. Matney, Jr.
*Attorney, Agent, or Firm*—Felfe & Lynch

[57] ABSTRACT

A melt-spinning device comprises an essentially sealed spinning chamber (3) mounted in a gas-tight manner between a spinneret bundle (2) and a yarn suction device (7). The spinning chamber (3) is partially perforated only in the region located 150 to 350 mm from the spinneret bundle. At a winding-off speed of 5,500 m/min, the filament produced has a count irregularity less than 0.60% U.

1 Claim, 1 Drawing Sheet

APPARATUS FOR MELT SPINNING WITH HIGH PULL-OFF SPEEDS AND FILAMENT PRODUCED BY MEANS OF THE APPARATUS

This application is a continuation of application Ser. No. 07/490,559, filed Apr. 17, 1990, now abandoned.

The invention relates to an apparatus for melt spinning with pull-off speeds of more than 5,000 m/min, consisting of a spinning block with a spinneret bundle and a yarn suction nozzle, as well as to a filament produced pursuant to the method.

BACKGROUND OF THE INVENTION

In melt spinning at high pull-off speeds, cooling of the filament represents the critical step of the method. The problem lies therein that, on the one hand, the yarn temperature must be lowered drastically and, on the other, the yarn speed must be increased.

Yarn suction nozzles for cooling yarns in melt spinning with speeds of more than 5,000 m/min are known. On the one hand, they take in the yarns and, on the other, serve to supply a cooling gas parallel to the yarns.

Pursuant to the EP-B-0 056 963, such a nozzle is used in conjunction with a heating chamber, the heating chamber being mounted directly underneath the spinning block.

The EP-A-0 244 217 discloses the use of such a nozzle for the same purpose in conjunction with a Venturi nozzle, which is operated with a hot gas. The Venturi nozzle is also mounted directly under the spinning block.

The heating chamber as well as the Venturi nozzle that is operated with a hot gas, both of which are mounted directly below the spinning block, serve to improve the course of the spinning and the yarn properties. As far as the yarn properties are concerned, above all the dyeability is affected positively by these.

The yarn suction nozzle for cooling the yarn is between 50 and 600 mm below the heating chamber in the case of the heating chamber and a sufficient distance below the Venturi nozzle in the case of the Venturi nozzle, so that the air emerging there does not adversely affect the operation the Venturi nozzle. The yarns enter the yarn suction nozzle as an open bundle. Because of the delayed cooling of the yarns, the latter are still quite fluid, that is, solidified only a little, on their way to the yarn suction nozzle.

In this section, the yarns are not stabilized in any way against lateral migrations, that is, against migrations perpendicular to the running direction of the yarns. Such lateral migrations lead to sinusoidal titer fluctuations along the fiber bundle so produced. These fluctuations, in turn, have a negative effect on the dyeability and the strength.

SUMMARY OF THE INVENTION

It is an object of the invention to provide an apparatus, which permits the titer regularity and the strength of a very rapidly spun filament to be improved.

It is a further object of the invention to reduce the energy-consuming operation of a heating chamber or the equally energy-consuming hot air consumption.

These objectives are accomplished by the apparatus shown in the accompanying drawing, which is characterized in that a spinning chamber is disposed between a spinneret bundle and the yarn suction nozzle.

By means of the inventive arrangement, a reduced pressure is developed in the spinning chamber. This reduced pressure selectively aspirates cooling air from the surroundings and surprisingly produces outstanding titer regularity along the resulting yarn.

It is advantageous to mount the spinning chamber in gas-tight fashion with its inlet opening at the spinning block and with its outlet opening at the yarn suction nozzle. The attachment is accomplished in a known manner, using a sealing material. It is advantageous to the flow of air if the bottom of the spinning chamber is funnel-shaped.

The spinning chamber consists essentially of a tube, which is closed off at its periphery and is constructed as a perforated tube only within a certain region and, moreover, from 150 to 350 mm and particularly from 200 to 300 mm from the spinneret bundle. Instead of a perforated tube, the perforated region can also be provided with any openings for the passage of gas.

It is advantageous to provide the openings in an annulus that is 50 to 150 mm wide or to provide a perforated tube of the same length.

In any case, the air permeability of the perforated tube shall be 20 to 40%, that is, 20 to 40% of the perforated surface shall be provided with openings.

A filament, prepared with the inventive apparatus, has a titer irregularity of <0.60% Uster.

BRIEF DESCRIPTION OF THE DRAWING

The invention will be described in greater details by means of a drawing, in which the following are shown.

DESCRIPTION OF THE PREFERRED EMBODIMENT

Figure 1:
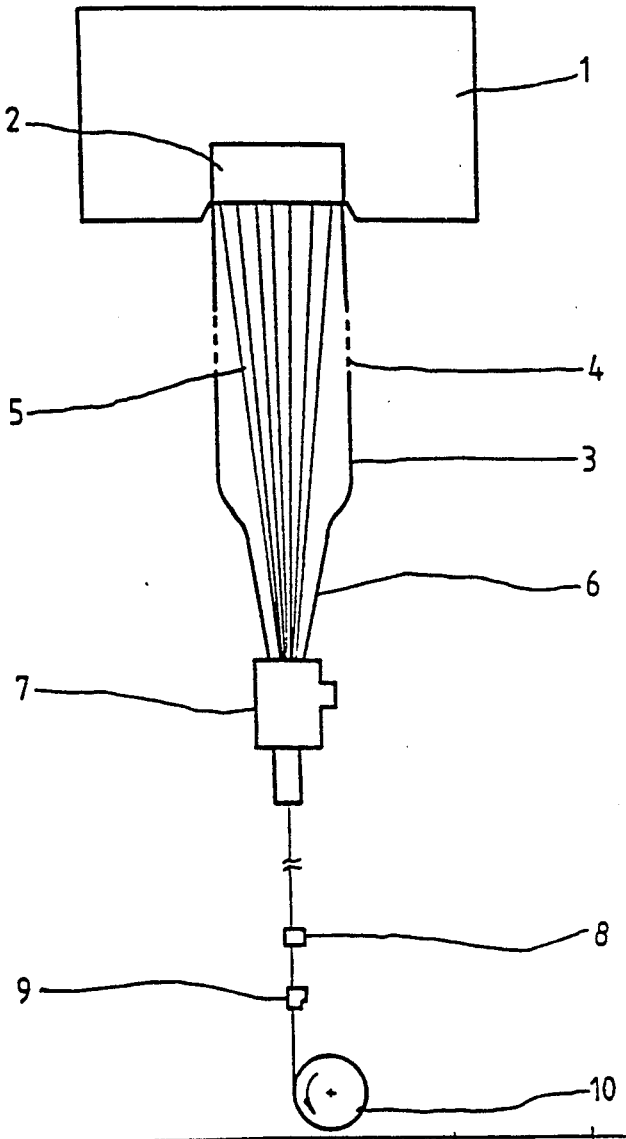
FIG. 1 shows a diagrammatic spinning facility with the inventive spinning chamber.
Figure 2:
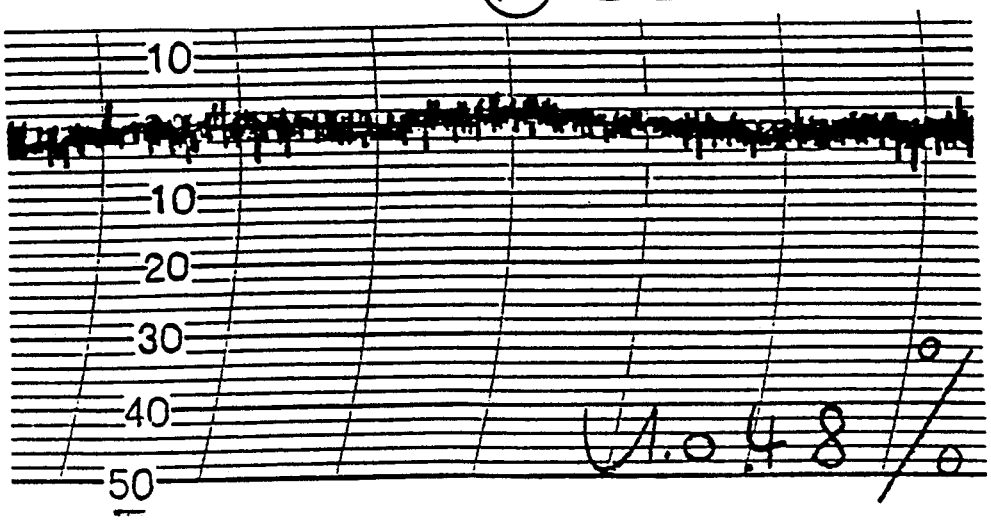
FIG. 2 shows an Uster diagram of a filament prepared with the inventive spinning facility.

In FIG. 1, a spinning block is labelled 1. A spinneret bundle 2, which is set back slightly, is provided in the spinning block 1. A spinning chamber 3, which preferably consists of a tube that is closed off almost over the whole of its length, has a gas-permeable ring, which is referred to as a perforated tube 4, at a distance of about 200 to 300 mm from the spinneret bundle 2. In its lower part, the spinning chamber 3 is constructed as a funnel 6 and dimensioned so that the filaments 5, which leave the spinneret bundle 2, cannot touch the wall of the spinning chamber 3. A yarn-suction nozzle 7 is connected gas-tight with the apex of the funnel 6 and provided at the convergence point of the filament bundle. Furthermore, a yarn lubricator 8, an intermingling jet 9 and a pull-off roller 10 for passing on the filament yarn to the spooler 10 are provided. The spooler can also be used directly instead of the pull-off roller 10.

To operate the apparatus, a melt-spinnable granulate is melted in a known manner in the spinning block 1 and spun into filaments 5 by the spinneret bundle 2. Due to the suction action of the yarn suction nozzle 7, a reduced pressure is developed in the spinning chamber 3. As a result, room air flows through the perforated tube 4 of the spinning chamber 3 and cools the filaments 5, which are being pulled off at high speed by means of the spool 10. Before the filaments 5 are wound up on the spool 10, they pass through the yarn lubricator 8 and the intermingling jet 9.

EXAMPLES OF THE OPERATION

A polyester granulate with an intrinsic viscosity (IV) of 0.62 dl/g is melted at 298° C. in the spinning block 1 and spun into 24 filaments with a total titer of 50 dtex at a pull-off speed of 5,500 m/min. The spinning chamber was 460 mm long and, at a distance between 150 and 250 mm below the spinneret, was provided with perforations with a permeability of 38%. The yarn suction nozzle 7 was acted upon by air at a pressure of 1 bar and showed an air consumption of 5.6 $Nm^3/h$. On leaving the yarn suction nozzle 7, the yarn was provided in a known manner with a spin preparation and intermingled.

A yarn resulted wit the properties given in column 3 of the Table.

| | Without a Spinning Chamber | With an Inventive Spinning Chamber |
|---|---|---|
| Pressure bar | 1 | 1 |
| Air Consumption $Nm^{3/h}$ | 5.6 | 5.6 |
| Elongation % | 63.0 | 59.8 |
| Strength cN/tex | 28.1 | 34.1 |
| Uster % | 0.98 | 0.48 |

The Table shows that a filament yarn, produced with the invention apparatus, shows a significant improvement in yarn cleanliness and an increase in strength.

Key for FIG. 1:

1=spinning block
2=spinneret bundle
3=spinning chamber
4=perforated tube
5=filaments
6=funnel of the spinning chamber
7=yarn suction nozzle
8=yarn lubricator
9=intermingling jet
10=pull-off roller.

I claim:

1. An apparatus for melt-spinning a polyester yarn with spinning speeds of more than 5,000 m/min, consisting only of a spinning block containing a spinneret, a downwardly extending cylindrical spinning chamber having an upper end and a narrowing lower end, the upper end of said spinning chamber being in gas-tight connection with said spinneret, and the narrowing lower end of said spinning chamber being in gas-tight connection with a yarn suction nozzle, and means for winding up the spun yarn exiting from the yarn suction nozzle, the overall length of said spinning chamber being about 460 mm, a plurality of perforations in the wall of said spinning chamber, said perforations forming a 20 to 40% air permeability zone extending 50 to 150 mm at a distance of 100 to 350 mm from said spinneret.

* * * * *